US006302222B1

(12) United States Patent
Vessat

(10) Patent No.: US 6,302,222 B1
(45) Date of Patent: Oct. 16, 2001

(54) DEVICE FOR THE TRANSMISSION AND DISTRIBUTION OF THE VIBRATION AND STRESS EXERTED ON OBJECTS BY A VIBRATOR TO DRIVE THEM INTO THE GROUND

(75) Inventor: Michel Vessat, Montreuil (FR)

(73) Assignee: PTC (FR)

( * ) Notice: Subject to any disclaimer, the term of this patent is extended or adjusted under 35 U.S.C. 154(b) by 0 days.

(21) Appl. No.: 09/423,728

(22) PCT Filed: Apr. 24, 1998

(86) PCT No.: PCT/FR98/00835

§ 371 Date: Nov. 12, 1999

§ 102(e) Date: Nov. 12, 1999

(87) PCT Pub. No.: WO98/53149

PCT Pub. Date: Nov. 26, 1998

(30) Foreign Application Priority Data

May 16, 1997 (FR) ..... 97 06230

(51) Int. Cl.[7] ..... E02D 13/02

(52) U.S. Cl. ..... 175/55; 173/49; 405/232; 405/249

(58) Field of Search ..... 405/232, 249; 175/55; 173/49

(56) References Cited

U.S. PATENT DOCUMENTS

| | | | | |
|---|---|---|---|---|
| 3,100,382 | * | 8/1963 | Muller | 175/55 |
| 3,224,514 | * | 12/1965 | Hornstein et al. | 173/49 |
| 3,828,864 | * | 8/1974 | Haverkamp et al. | 173/49 |
| 3,920,083 | * | 11/1975 | Makita | 173/49 |
| 5,263,544 | * | 11/1993 | White | 173/49 |
| 5,653,556 | * | 8/1997 | White | 405/249 |
| 5,823,272 | * | 10/1998 | Van Halteren | 173/49 |
| 5,988,297 | * | 11/1999 | Zimmerman et al. | 173/49 |
| 6,073,704 | * | 6/2000 | Yasuoka et al. | 173/49 |

* cited by examiner

*Primary Examiner*—David Bagnell
*Assistant Examiner*—Frederick L. Lagman
(74) *Attorney, Agent, or Firm*—William A. Drucker

(57) ABSTRACT

A device for transmitting and distributing vibration and stress exerted by a vibrator on objects to be driven into the ground includes a supporting plate of repartition of vibrations bolted on a sole plate of the vibrator having dimensions lower to that of the supporting plate. A "I" shaped profiled rail is on its entire length on the supporting movable plate supporting movable hydraulic clamps.

10 Claims, 5 Drawing Sheets

DEVICE FOR THE TRANSMISSION AND DISTRIBUTION OF THE VIBRATION AND STRESS EXERTED ON OBJECTS BY A VIBRATOR TO DRIVE THEM INTO THE GROUND

BACKGROUND OF THE INVENTION

1. Field of the Invention

This invention relates to a device for the transmission and distribution of the vibration and stress exerted by a vibrator on objects such as stakes, tubes or sheet piles, with a view to driving them home, with a horizontal cross-section of dimensions exceeding those of the vibrator.

2. Description of the Prior Art

We know that the vibrators commonly used for this type of application are huge machines comprising at least one couple of offset rotary weights rotated in opposite directions and at a same speed by a motorization.

By way of these arrangements, the centrifugal forces generated by the rotation of the weights add up in a direction defining an axis of work. The centrifugal forces compensate one another in the other directions to cancel one another out in a direction perpendicular to the axis of work.

Usually, the vibrator is suspended at the end of the cable of a crane or similar mechanism, via a device (lifting eye) enabling the vibrator to be displaced vertically.

In the case of the cross-section of the object to be driven into the ground being greater than that of the vibrator, the transmission and distribution of the stress between the vibrator and the object to be driven into the ground are usually performed by a transmission and distribution chamber made of welded sheet steel which is fastened on one side, e.g. by bolting, to the underside of the vibrator (usually a fastening sole plate) and which bears, on the other side, a fastening device that can be adapted to the dimensions of the object to be driven into the ground. This chamber can, e.g., be constituted by two braced parallel plates by a partitioning forming crossbars as represented in U.S. Pat. No. 3,224,514.

When tubular stakes are involved, this device comprises a multiplex device, e.g. a so-called "quadriplex" device, made up of four rail sections or four "T"s bolted to the chambers and a hydraulic clamp mounted slidably with a locking facility on each of the sections or "T"s.

Experience has shown that, due to the intense stress to which it is subjected, the transmission and distribution chamber tends to deteriorate rapidly and must be frequently reloaded or replaced.

Detailed examination of the used chambers reveals that the deteriorations materialised in the form of cracks located along the welding seams and at the base of the protruding portions of the vibrodriver sole plate are due both to the quality of the chamber welding seams and to the heterogeneity in the mechanical behaviour of the chamber at the level of the welding seams. It so happens that this heterogeneity is particularly significant due to the distribution of the reverse bendings at the frequency of the vibrations generated by the vibrator.

OBJECT OF THE INVENTION

The aim of the invention is therefore more particularly to remedy these drawbacks.

To this end, the invention proposes a vibrator of type comprising at inside of a case at least one pair of eccentric-rotary weights driven in rotation, in the opposed direction, at a same speed, by a motorization and least one hydraulic clamp mounted sliding on a profiled rail integral with the lower part of said case.

SUMMARY OF THE INVENTION

According the invention, this vibrator is characterized in that:

- the underside of the case is formed by a sole plate whose dimensions sensibly correspond to those of a cross section of the vibrator and on which is assembled by bolting a supporting plate of repartition of vibration and stress whose dimensions are selected so as to exceed the dimensions of said sole plate, and
- the said profiled rail presents a "I" shaped cross section and is bolted on said plate.

In cases where it is possible to limit the number of fastening points to two, the rail can be rectilinear and bear two hydraulic clamps.

Conversely, in cases where the object to be driven into the ground is of tubular shape and requires more than two fastening points, the vibration and stress transmission and distribution device can comprise at least one cross-piece made with profiled rails of "I"-shaped cross-section, and assembled by bolting thereof to the supporting plate, each of the branches of this cross-piece bearing a hydraulic clamp. One can readily envisage six rail sections each bearing a clamp when required by virtue of the force to be transmitted.

The device embodying the invention does not therefore require any welding (only the branches of the cross-piece need be welded together where they meet).

Furthermore, the invention derives benefit from the "I"-shaped structure both in terms of the transmission of stress and the bending behaviour.

Likewise, the elastic deformation of the cross-piece adapts excellently to that of the supporting plate and fastening sole plate of the vibrator.

The life span of the device is therefore considerably extended.

BRIEF DESCRIPTION OF THE DRAWINGS

An embodiment of the invention will be described hereunder, by way of a non-limiting example, in reference to the corresponding accompanying drawings in which.

DESCRIPTION OF THE PREFERRED EMBODIMENTS

Figure 2:
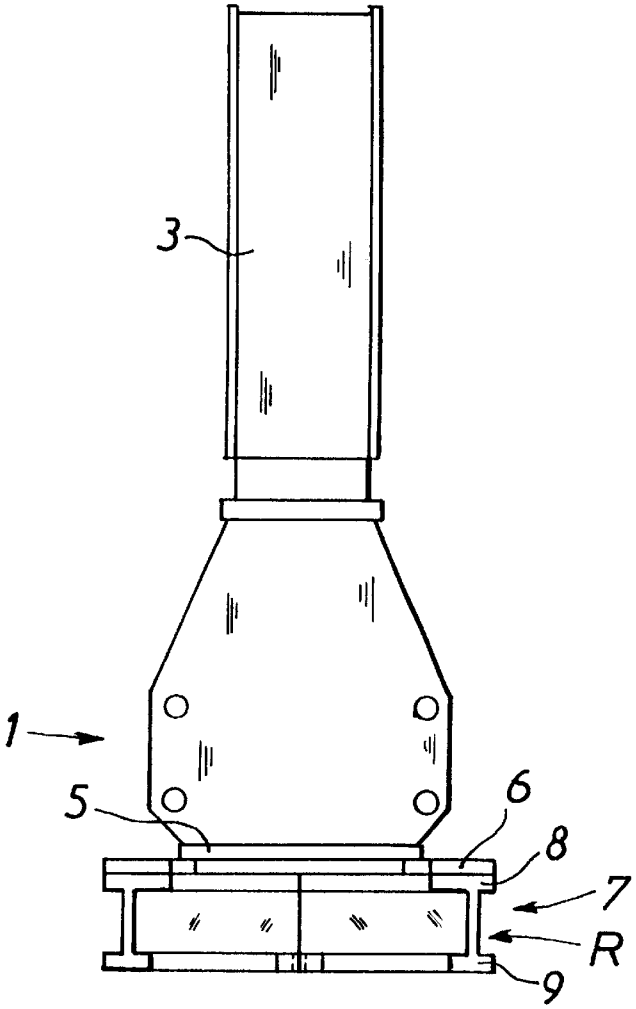
FIGS. 1 and 2 are frontal and side views of a vibrator equipped with a transmission and distribution device according to the invention.

In these examples, the vibrator 1 is comprised of a substantially parallelepiped case 2 in which are rotatably mounted three series of weights $M_1$ to $M_4$, $M'_1$ to $M'_4$, $M''_1$ to $M''_4$ each comprising four weight/pinion assemblies meshing with one another.

These series of weights are rotatably driven by means of at least one hydraulic motor (in this instance four hydraulic motors of which two, $MH_1$ and $MH_2$ are visible).

The hoisting of the vibrator by means of a lifting device such as a a crane is performed via a lifting eye 3 equipped with a means for damping the vibrations, this assembly being mounted on the upper part of the vibrator 1.

As previously stated, the transmission and distribution of the vibrations, generated by the vibrator, to the objects to be driven into the ground (stakes, sheet piles) are ensured by a vibration and stress distribution device 4 which is secured by bolting to a sole plate 5 constituting the underside of the vibrator 1 and whose dimensions correspond substantially to those of a horizontal cross-section of the vibrator.

Figure 1:
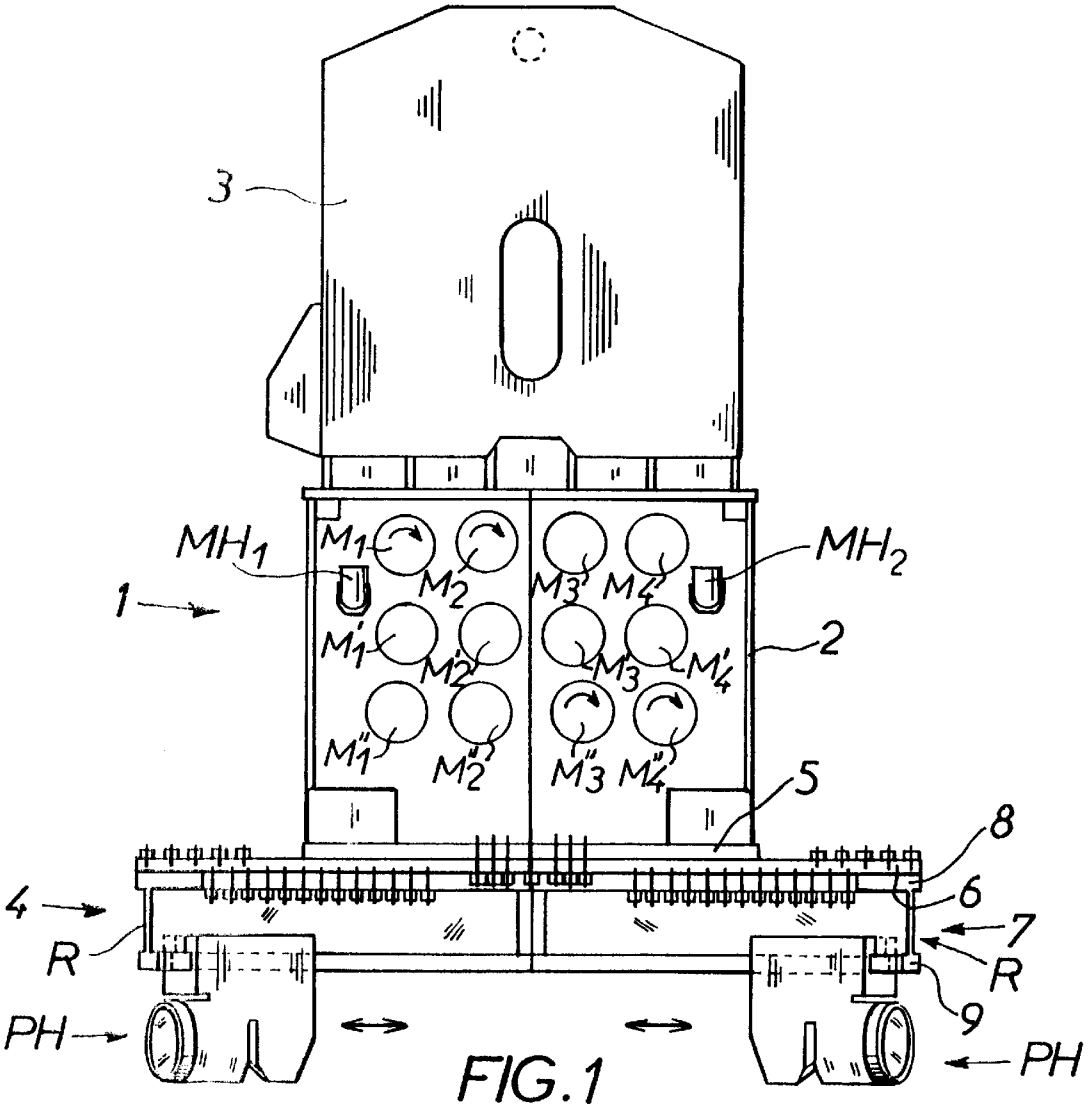
Figure 4:
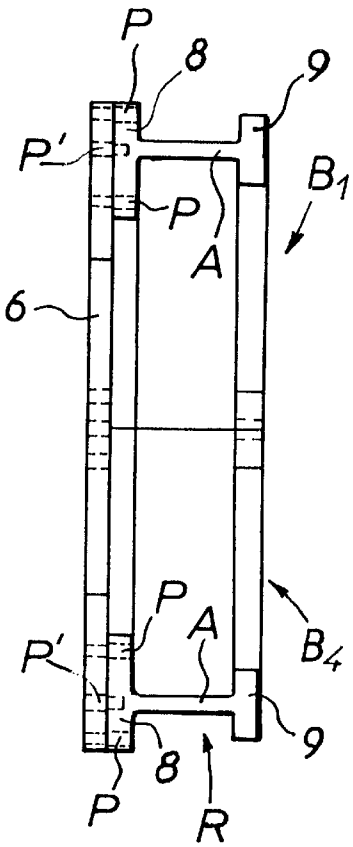
FIGS. 3 and 4 are respectively views from underneath (FIG. 3) and the side (FIG. 4) of the transmission and distribution device of the vibrator represented in FIGS. 1 and 2.
Figure 3:
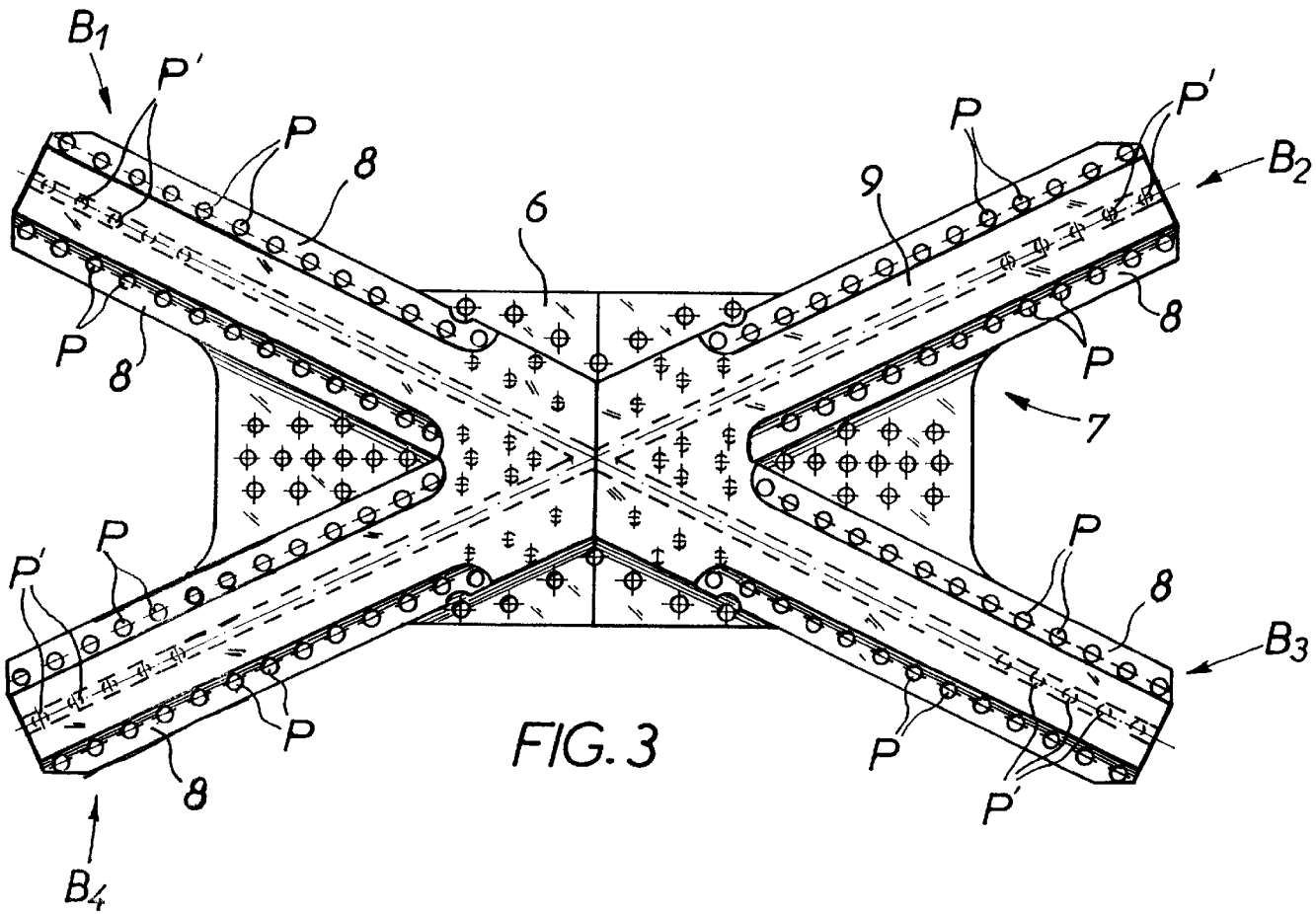
Figure 5:
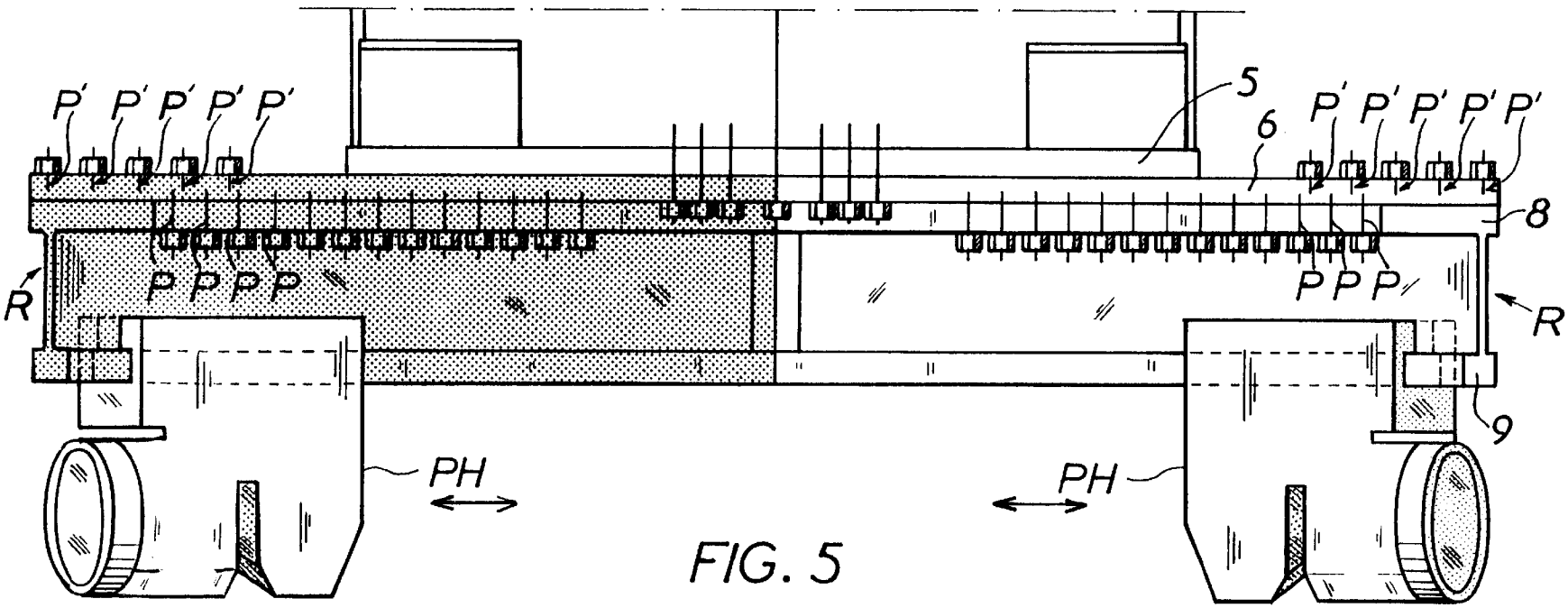
FIG. 5 is a partial view on a larger scale of the vibrator represented in FIG. 1, this view enabling a more accurate description to be provided of the location of the bolts fastening the rail sections to the supporting plate.

In the example represented in FIGS. 1 to 3, this device 4 uses a supporting plate 6 whose dimensions exceed those of the sole plate and to which a cross-piece 7 is fastened by bolting, each of the branches $B_1$ to $B_4$ of said cross-piece consisting of a profiled rail R of "I"-shaped cross-section.

The cross-piece 7 is bolted to the supporting plate 6 by means of bolts which pass through a plurality of through holes P respectively opening out at the level of the transversal wings 8 on either side of the vertical web of the "T".

This fastening is further completed, in each end of the rail section R by a series of bolts (5 in this instance) which pass through the supporting plate 6 and which come and screw into the respective threaded holes P' made in the transversal wing 8, these holes having their axis in the longitudinal mid-plane of symmetry of the rail section R.

These boltings enable the transversal wings 8 of the rails R (preferably larger than the transversal wings 9) to be fastened efficiently to the supporting plate 6 while ensuring good mechanical symmetry.

By way of these arrangements, the mechanical properties of the "I"-shaped structures are put to best advantage both in terms of bending and in terms of the transmission of stress (vibrations) between the supporting plate 6 and the hydraulic clamps PH mounted slidably on the rails at the level of the transversal wings 9.

Figure 6:
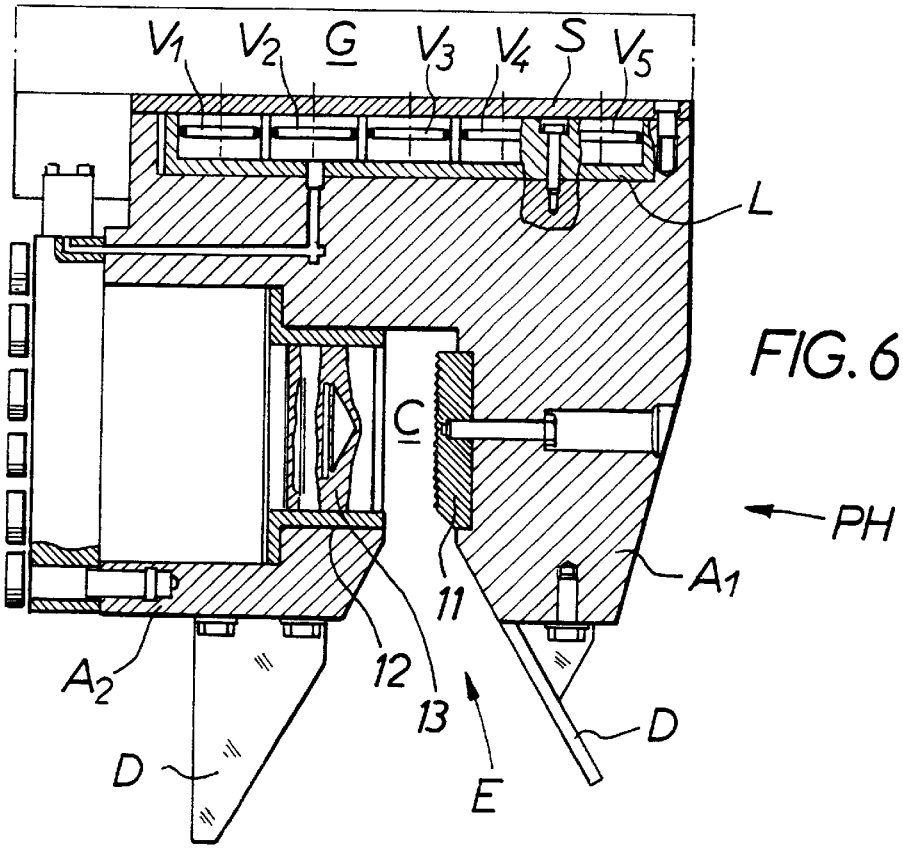
FIGS. 6 and 7 are axial (FIG. 6) and transversal (FIG. 7) cutaway views, on a larger scale, of a hydraulic clamp.
Figure 7:
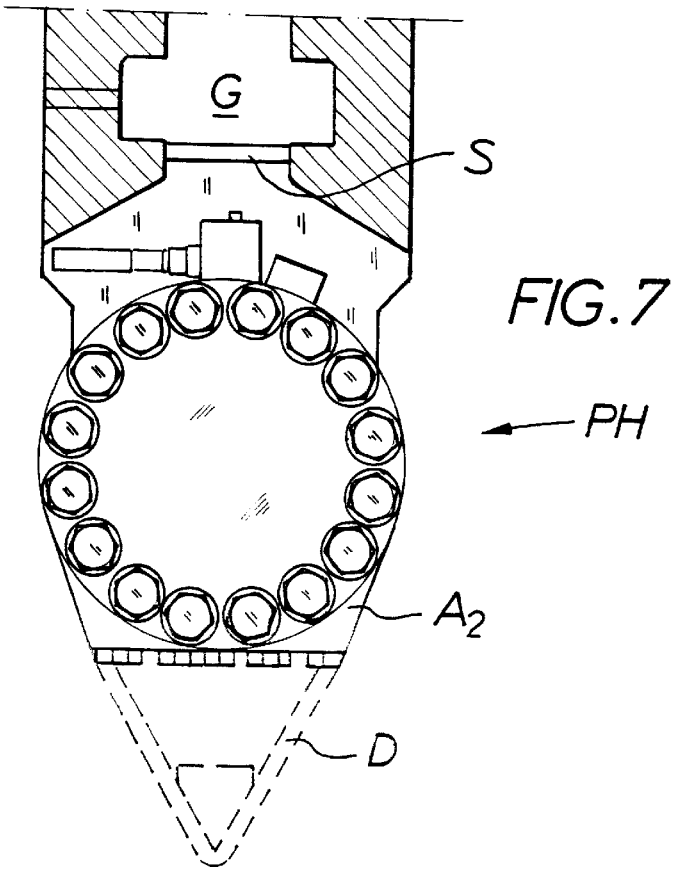

In the example illustrated in FIGS. 6 and 7, the clamps PH are each composed of a massive body comprising, on one side, a profiled groove G of "T"-shaped cross-section substantially complementary to that of the lower part of a rail (web A+transversal wing 9) into which it can fit and slide.

The lower part of the body is, in a plane perpendicular to the profiled groove G, of a form having a substantially "U"-shaped cross-section with relatively thick wings $A_1$, $A_2$ constituting the jaws of the clamp. These wings $A_1$, $A_2$ delimit a cavity C into which is fitted the edge of the object to be driven into the ground, e.g. the edge of the tube constituting a stake.

To the inner wall of the wing $A_1$ is bolted a block 11 whose outer side is striated so as to have good surface roughness.

As for the wing $A_2$, it comprises a transversal bore 12 (perpendicular to the axis of the "U"-shaped cavity) which opens out into its inner wall, at right angles to the block. This bore 12 constitutes the cylinder of a jack of which the piston 13 can enter the cavity C, under the effect of the pressure exerted by a hydraulic fluid, to grip the upper edge of the part to be driven into the ground.

The axial locking of the clamp PH onto the profiled rail R is ensured by five small hydraulic jacks $V_1$ to $V_5$ oriented vertically, arranged in a housing L of the body opening out into the lower (horizontal) wall of the groove G.

These jacks $V_1$ to $V_5$ act on a mobile sole plate S guided by the upper edges of the housing L and which, under the effect of the pressure exerted, come to bear against the lower side of the rail R while axially locking the clamp PH to the latter.

These arrangements enable the vibrator to be adapted very easily to objects of different shapes and dimensions.

The locking of the clamp onto these objects is further facilitated by a flaring E of the cavity extended by deflectors D extending obliquely in relation to the vertical line.

The invention is not, of course, limited to the embodiment described above.

In fact, the stress transmission and distribution device could comprise a much larger number of rail sections.

Figure 8:
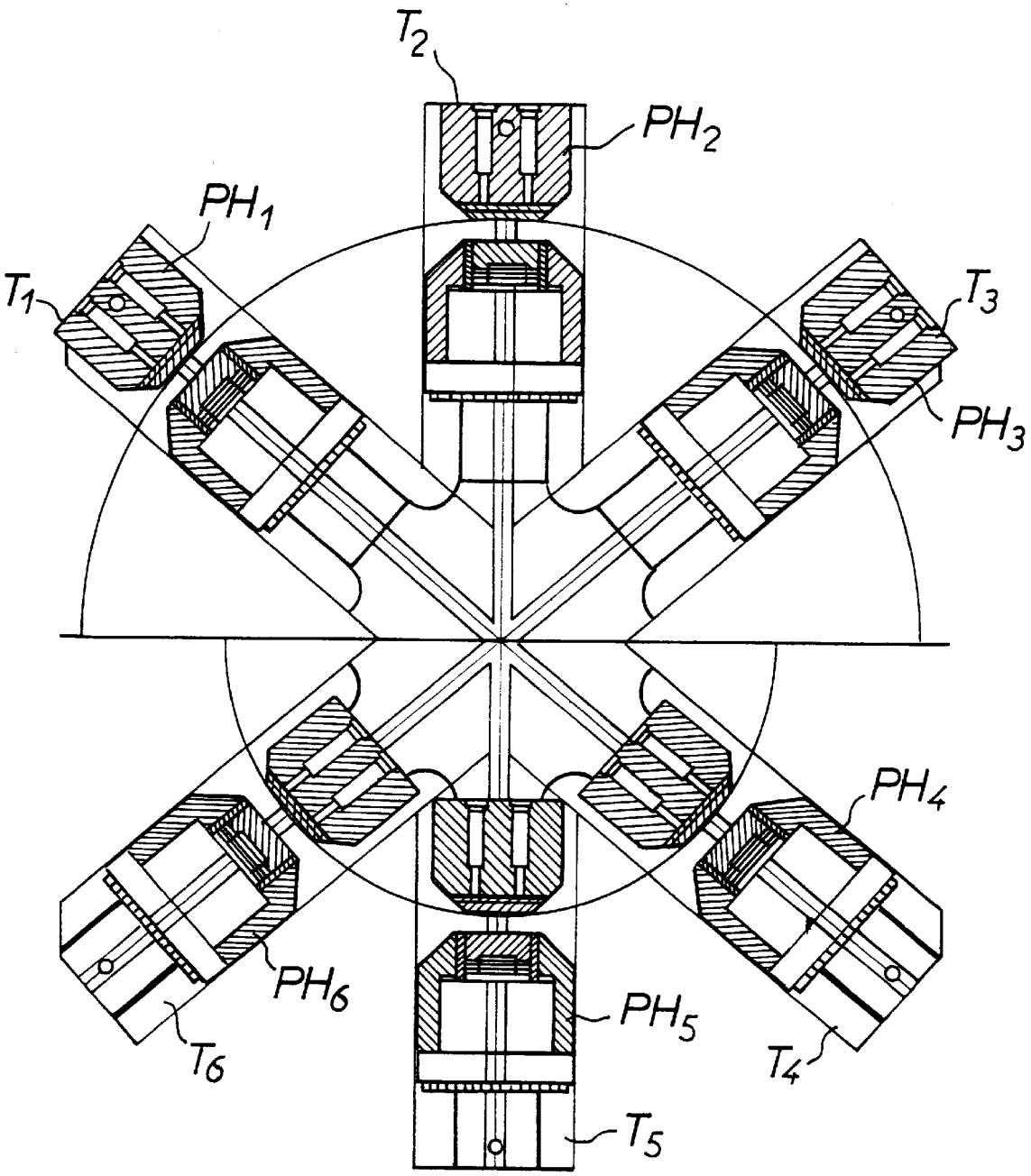
FIG. 8 is a view from beneath of a transmission and distribution device equipped with six rail sections.

Thus, this (multiplex) device could comprise six rail sections $T_1$ to $T_6$ arranged in the shape of a star as represented in FIG. 8.

In this example, the rail sections $T_1$ to $T_6$ are arranged according to two diametrically opposite sets of three sections $T_1$ to $T_3$ and $T_4$ to $T_6$, angled at 45° to one another.

The hydraulic clamps $PH_1$ to $PH_3$ borne by the set of rail sections $T_1$ to $T_3$ are arranged so as to clamp a cylindrical part of maximum diameter, whereas the clamps $PH_4$ to $PH_6$ borne by the set of rail sections $T_4$ to $T_6$ are arranged so as to clamp a part of minimum diameter.

What is claimed is:

1. Vibrator for driving an object into the ground, said vibrator comprising a case having a horizontal cross section smaller than that of said object, said case enclosing at least one pair of eccentric rotary weights driven in rotation in the opposed directions at a same speed by a motorization, said case having an underside formed by a horizontal sole plate whose dimensions in a horizontal plane adjacent to the sole plate are substantially equal to those of said plate, a supporting plate of repartition of vibrations and stress having dimensions exceeding those of said sole plate, said supporting plate being bolted on said sole plate, a profiled rail fixed on its entire length on said supporting plate of repartition by means of a plurality of bolts, said profiled rail having I shaped cross section and at least one hydraulic clamp mounted sliding on said profiled rail.

2. Vibrator as claimed in claim 1, which comprises a cross-piece having several branches and made with profiled rail sections of "I"-shaped cross-section, and assembled by bolting to the supporting plate, each of said branches of this cross-piece bearing a hydraulic clamp.

3. Vibrator as claimed in claim 2, wherein said rail has a web and first and second transversal wings and is bolted to the supporting plate by means of bolts passing through a plurality of through holes opening out respectively at the level of one of said transversal wings of the rail on either side of the web of said rail.

4. Vibrator as claimed in claim 3, wherein said first transversal wing of said rail which bears against the supporting plate is larger than the second transversal wing.

5. Vibrator as claimed in claim 3, wherein each rail section is fastened to the supporting plate by a series of bolts passing through the supporting plate to come and screw into respective threaded bores made in said second transversal wing of said rail section, these bores being oriented in the longitudinal mid-plane of symmetry of said rail section.

6. Vibrator as claimed in claim 5, wherein said threaded bores are arranged at one end of the rail section.

7. Vibrator as claimed in claim 2, wherein said cross-piece comprises at least four rail sections.

8. Vibrator as claimed in claim 1, wherein said clamps are composed of a massive body comprising, a first side, having a profiled groove of "T"-shaped cross-section, and, a second side, having a "U" shape with two thick wings delimiting a cavity into which is fitted an edge of an object to be driven into the ground, one of these two thick wings comprising a transversal bore constituting a cylinder of a jack whose piston can enter said cavity to clamp said edge.

9. Vibrator as claimed in claim 8, wherein the clamp is axially locked to the rail by means of vertically oriented hydraulic jacks acting on a sole plate bearing against the underside of the rail.

10. Vibrator for driving an object into the ground, said vibrator comprising a case having a horizontal cross section smaller than that of said object, said case enclosing at least one pair of eccentric rotary weights driven in rotation in the opposed direction at a same speed by motorization, said case having an underside formed by a horizontal sole plate whose dimensions in a horizontal plane adjacent to the sole plate are substantially equal to those of said plate, a supporting plate of repartition of vibrations and stress having dimensions exceeding those of said sole plate, said supporting plate being bolted on said sole plate, a "I" shaped profiled rail having a web and a first and a second lateral wings said rail being fixed on its entire length on said supporting plate of repartition by means of said set of bolts passing through a plurality of through holes opening out respectively at the level of said first transversal wing on either side of said web and by means of a second set of bolts passing through the supporting plate and screwed into respective threaded bores made in said second transversal wing at one end portion of the profiled rail, said set of threaded bores being oriented in the longitudinal mid-plane of symmetry of the profiled rail, and at least one hydraulic clamp mounted sliding on said profiled rail.

* * * * *